US005772025A

United States Patent [19]

Chen et al.

[11] Patent Number: 5,772,025

[45] Date of Patent: Jun. 30, 1998

[54] BUFFERING PAD FOR DEVICE PACKAGES

[76] Inventors: Tony Chen; Alex Wang, both of No. 1-1, R & D Road 2, Science-Based Industry Park, Hsinchu, Taiwan

[21] Appl. No.: 789,976

[22] Filed: Jan. 28, 1997

[51] Int. Cl.[6] ..... B65D 81/113

[52] U.S. Cl. ..... 206/320; 206/587; 206/591

[58] Field of Search ..... 206/320, 521, 206/586–588, 591, 592, 594

[56] References Cited

U.S. PATENT DOCUMENTS

| | | | |
|---|---|---|---|
| 4,171,745 | 10/1979 | Zicko | 206/594 |
| 4,759,446 | 7/1988 | Dobashi et al. | 206/592 |
| 4,828,115 | 5/1989 | Wiegand et al. | 206/320 |
| 5,341,934 | 8/1994 | Hsu | 206/591 |
| 5,398,808 | 3/1995 | Chen et al. | 206/320 |
| 5,467,875 | 11/1995 | Sato | 206/588 |
| 5,501,339 | 3/1996 | Suzuki et al. | 206/588 |

FOREIGN PATENT DOCUMENTS 102711 7/1995 China .

*Primary Examiner*—Paul T. Sewell
*Assistant Examiner*—Luan K. Bui
*Attorney, Agent, or Firm*—Kenyon & Kenyon

[57] ABSTRACT

A buffering pad for device packages is provided. The buffering pad is composed of a main member, a pair of lateral supporting members, and at least one protection member. The main member and the lateral supporting members are each formed by folding an integral piece of cardboard. At least one buckling piece is integrally formed either on the main member or on the lateral supporting member for fastening the protection member to the main member. Alternatively, a supporting glove is used to fasten the protection member to the main member. The protection member is a substantially U-shaped block which provides support and enforcement to the portion where it is fastened to.

9 Claims, 16 Drawing Sheets

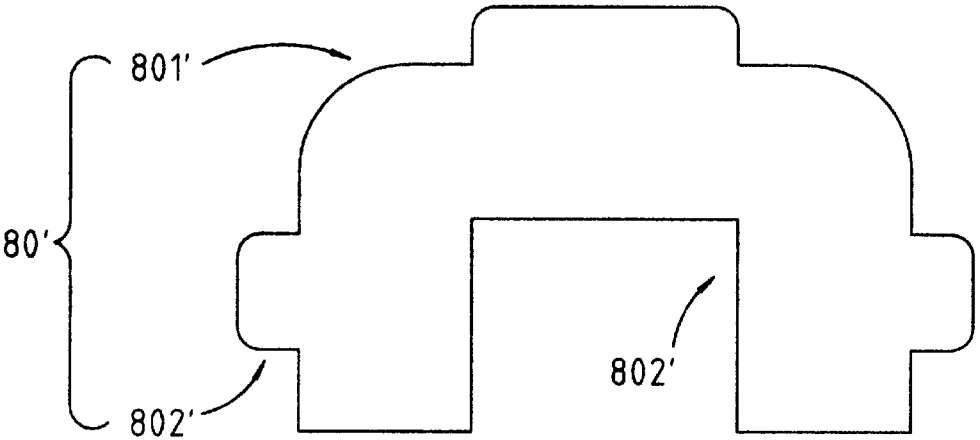
FIG. 10
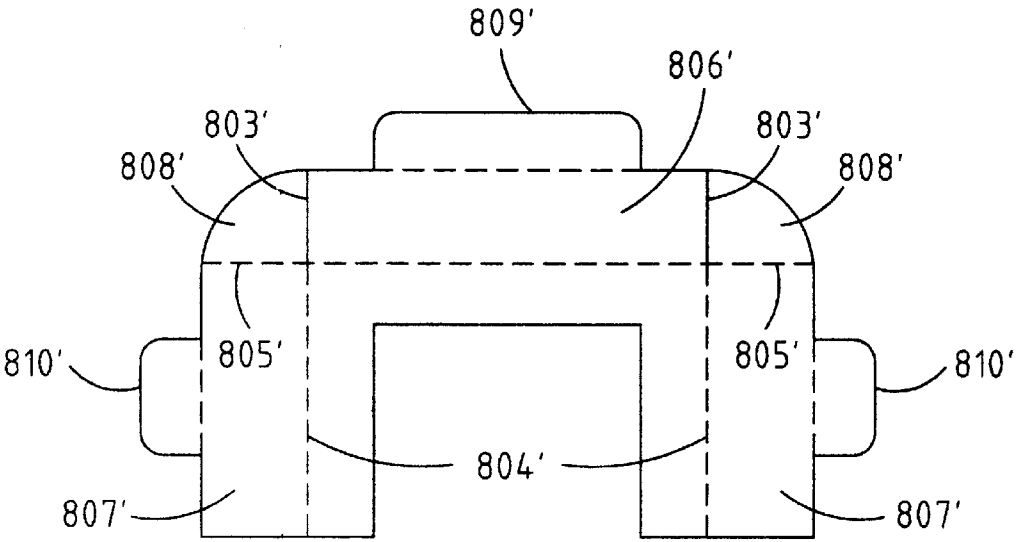

BUFFERING PAD FOR DEVICE PACKAGES

BACKGROUND OF THE INVENTION

1. Field of the Invention

This invention relates in general to a buffering pad for device packages that are used to pack electronic devices, computer equipment, electrical appliances, and the like, for delivery. In particular, the buffering pad is completely made of cardboard, or the like, with enforced strength and environmental friendliness.

2. Description of Related Art

Conventionally, the products of personal computers and their peripherals such as scanners, portable communications devices, office machines, and so on, are supplied to the customer by packing them with buffering pads made of plastic foams, for example, and then placing the product to be packed and the buffering pad packing the product in a carton made of cardboard. The buffering pad is designed specifically to protect the products against shocks or impacts during delivery.

The plastic foams, however, produce poisonous substances during the manufacturing process and which are difficult to be decomposed. Therefore, waste plastic foams cause harms to the environment. For the purpose of environmental protection, substitutes such as cardboard, EPE, EPS, EPP, PU, or a mixture thereof are used for the manufacturing of buffering pads in cartons. These materials, however, are still considered not totally environmentally friendly, costly to manufacture, and poor in the buffering effect. Therefore, there exists a need for a buffering pad which is completely made of cardboard. To meet this need, the applicant disclosed a buffering pad in ROC Utility Patent No. 102,711 published on Jul. 11, 1995 which is illustrated in FIG. 16. One drawback to this patent, however, is that it was designed specifically to pack upright devices. It would be inappropriate to use this buffering pad to pack leveled devices, such as the flatbed scanners, since the buffering pad lacks lateral enforcements to support the device with its lateral sides laid on the bottom. In other words, this patent only provides enforcements to support upright devices. There exists, therefore, a further need for a buffering pad which can support either upright or leveled devices. Further, since different devices usually have the center of weight thereof at different positions, the new buffering pad should be able to adjust for the center of weight of the devices being packed therein, so as to balance the support evenly. Still further, since environment protection is an important issue in today's industry, the new buffering pad should be compliant with the Green Design 3R Policy, i.e., Reduce→Reuse→Recycling, and the ISO14000 standards of environmental quality control. Therefore, the new buffering pad should be made completely without the use of plastic foams so that the pollution caused by plastic foams will be eliminated. The use of cardboard instead of plastic foams will have about a 30% cost down for the manufacturing of the buffering pads.

SUMMARY OF THE INVENTION

It is therefore a primary objective of the present invention to provide a buffering pad for device packages which are provided with enforcements on both base and lateral sides so as to be able to support either upright or leveled devices.

It is another objective of the present invention to provide a buffering pad for device packages which has good strength to provide adequate buffering effect for the products packed therein.

It is still another objective of the present invention to provide a buffering pad for device packages which includes constituent parts that can be combined without the use of glues, adhesives, or staples, and which can be dissembled easily.

It is yet another objective of the present invention to provide a buffering pad for device packages which is easy, less time-consuming, and less costly to manufacture.

It is still yet another objective of the present invention to provide a buffering pad for device packages which is completely environment-friendly no matter during manufacture, use, recycling, or waste treatments.

It is still further yet another objective of the present invention to provide a buffering pad for device packages which can adjust for the center of weight of the product being packed therein so as to provide balanced support.

In accordance with the foregoing and other objectives of the present invention, a new and improved buffering pad for device packages is provided.

The buffering pad is composed of a main member, at least two lateral supporting members, and at least one protection member.

Various modifications to the forms and combinations of the above constituent parts of the buffering pad are possible.

The main member is folded into form from a first piece of cardboard, having a base section, a pair of sidewall pieces joining said base section, and a pair of enforcement pieces joining each of said sidewall pieces. The cardboard is formed with at least two first elongated slots which extend over said base section and said sidewall pieces and two second elongated slots which extend over said base section. The first elongated slots are formed into a first insetting slot on the main member when the cardboard has been folded into form.

The lateral supporting members are each formed with at least two second insetting slots with depth corresponding to that of said first insetting slot on said main member and are each folded into form from a second piece of cardboard formed into an outer wall piece and an inner wall piece. The lateral supporting member is combined with said main member by insetting said second insetting slots on said lateral supporting member into said first insetting slot on said main member. Further, the lateral supporting member is integrally formed with a bucking piece from the inner wall piece thereof.

The protection member is substantially a U-shaped block fastened to said main member by strapping said buckling piece on said lateral supporting member around said main member.

The lateral supporting member is combined with the main member by insetting the second insetting slot on the lateral supporting member into the first insetting slot on the main member, and also by buckling the buckling piece in the main member. After the lateral supporting member is mounted in position in the main member, the protection member is attached to the main member at a position between the first insetting slot and the second elongated slots. Then, the buckling piece is folded up towards the protection member, and then the outermost part of the buckling piece is inserted into a slot which is formed by cutting the inner wall piece on the lateral supporting member to form the buckling piece. This allows the protection member to be fastened in position to the main member and lateral supporting member by the buckling piece.

The combination of the lateral supporting member and the main member can be carried out in several ways.

In the first aspect of the invention, a buckling piece is integrally formed with the lateral supporting member. Three folding lines are formed on the buckling piece so that it can be folded into four sections for surrounding the protection member. By means of the buckling piece, the protection member can be fastened to the main member.

In the second aspect of the invention, no buckling piece is used. Instead, a supporting glove is used to fasten the protection member to the main member. The supporting glove is formed by folding an integral piece of cardboard. The supporting glove is basically divided into a main piece and a pair of wing pieces, and is further divided by slits and folding lines into a flap piece, a pair of lateral flap pieces and a pair of engaging pieces. In addition, a head engaging piece is intergrally formed on the top of the flap piece and a pair of lateral engaging pieces are respectively integrally formed on the lateral flap pieces. The supporting glove fastens the protection member to the main member by inserting the head engaging piece and lateral engaging pieces formed thereon into a gap between said outer wall piece and said inner wall piece on said lateral supporting member, and also inserting said engaging pieces formed thereon respectively into the gaps between said flap piece and said protection member. This supporting glove helps to enforce the strength and buffering effect of the buffering pad.

In the third aspect of the invention, no buckling piece is formed on the lateral supporting member. Instead, a pair of buckling pieces are integrally formed on the main member. These buckling pieces are used to fasten the protection member to the main member. This allows the protection member to be fastened at a position far from the lateral supporting member, for example, in the middle of the main member to enforce the strength of that portion.

BRIEF DESCRIPTION OF DRAWINGS

The invention can be more fully understood by reading the following detailed description of the preferred embodiments, with reference made to the accompanying drawings, wherein:

FIG. 10 is a plan view of the paper cut design of a supporting glove of the second embodiment of the buffering pad;

DETAILED DESCRIPTION OF PREFERRED EMBODIMENT

Figure 1:
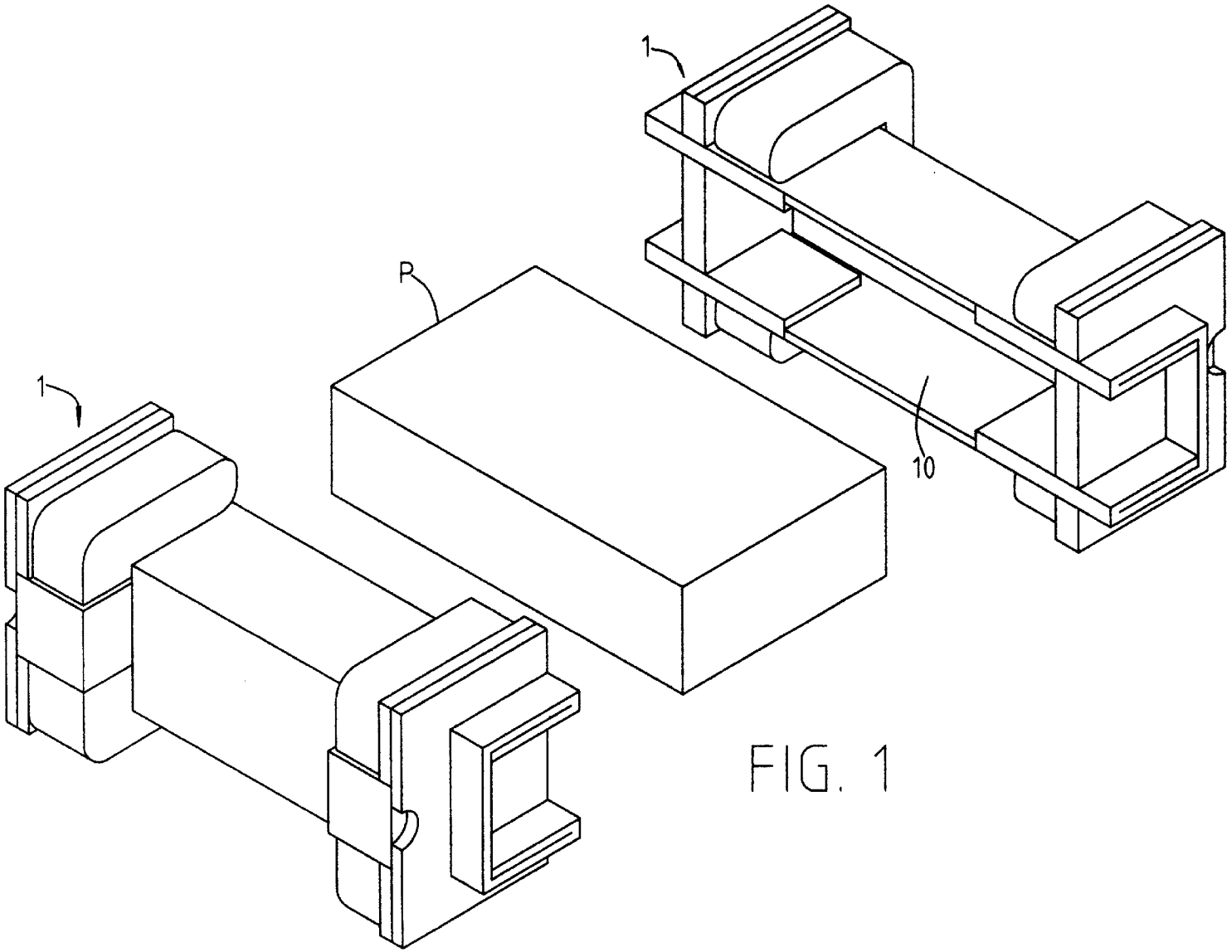
FIG. 1 is a perspective view of a first preferred embodiment of the buffering pad according to the present invention when used to pack a device.
Figure 15:
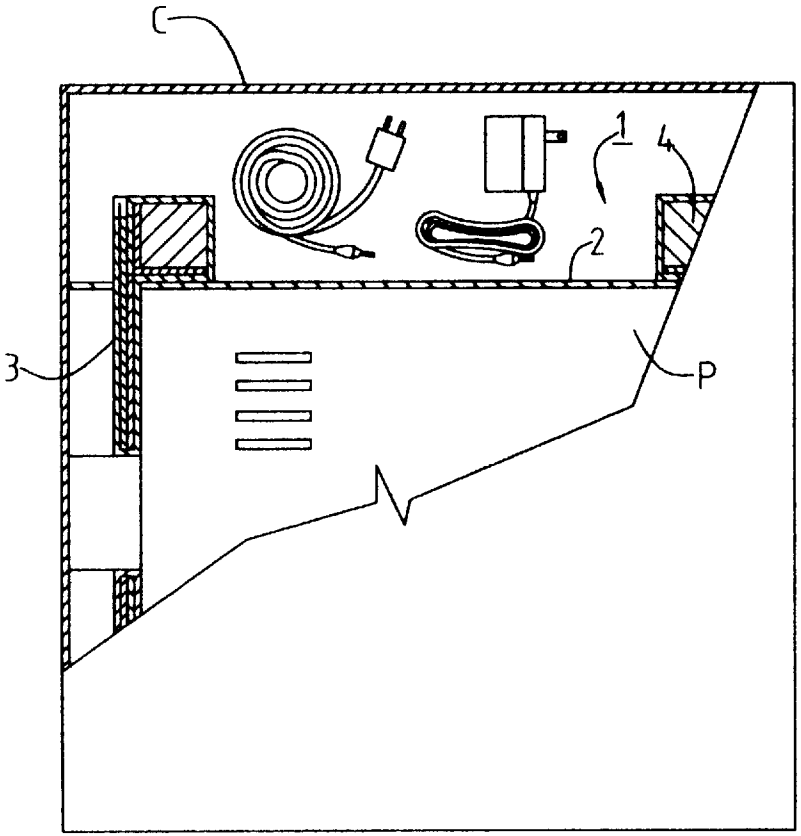
FIG. 15 is a perspective view of a carton packing a device with the buffering pad according to the present invention, with parts cut away to show the inside.
Figure 16:
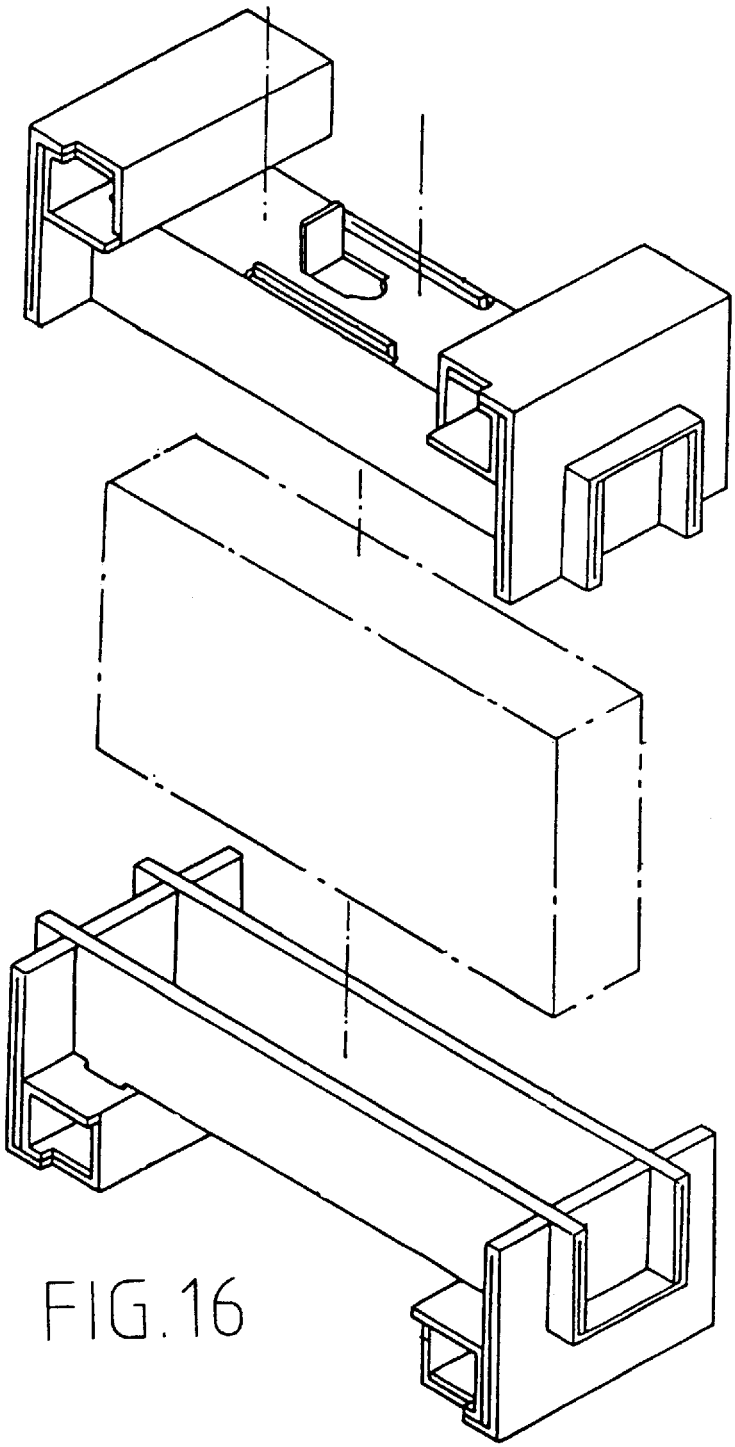
FIG. 16 is a perspective view of a conventional buffering pad when used to pack a deuce.

Referring to FIG. 1, there is shown a device P, which can be a scanner or the main unit of a personal computer, packed by a buffering pad according to the first preferred embodiment of the invention. In this embodiment the buffering pad includes two buffering units 1 each have a hollowed inside 10 used to wrap the device P therein. The two buffering units 1 are attached to both sides of the device P, and then, as illustrated in FIG. 15, the buffering units 1 along with the device P are placed in a carton C. During delivery of the device P to the customer, the two buffering units 1 protects the device P against shocks or impacts which might cause damage to the device P.

Figure 2:
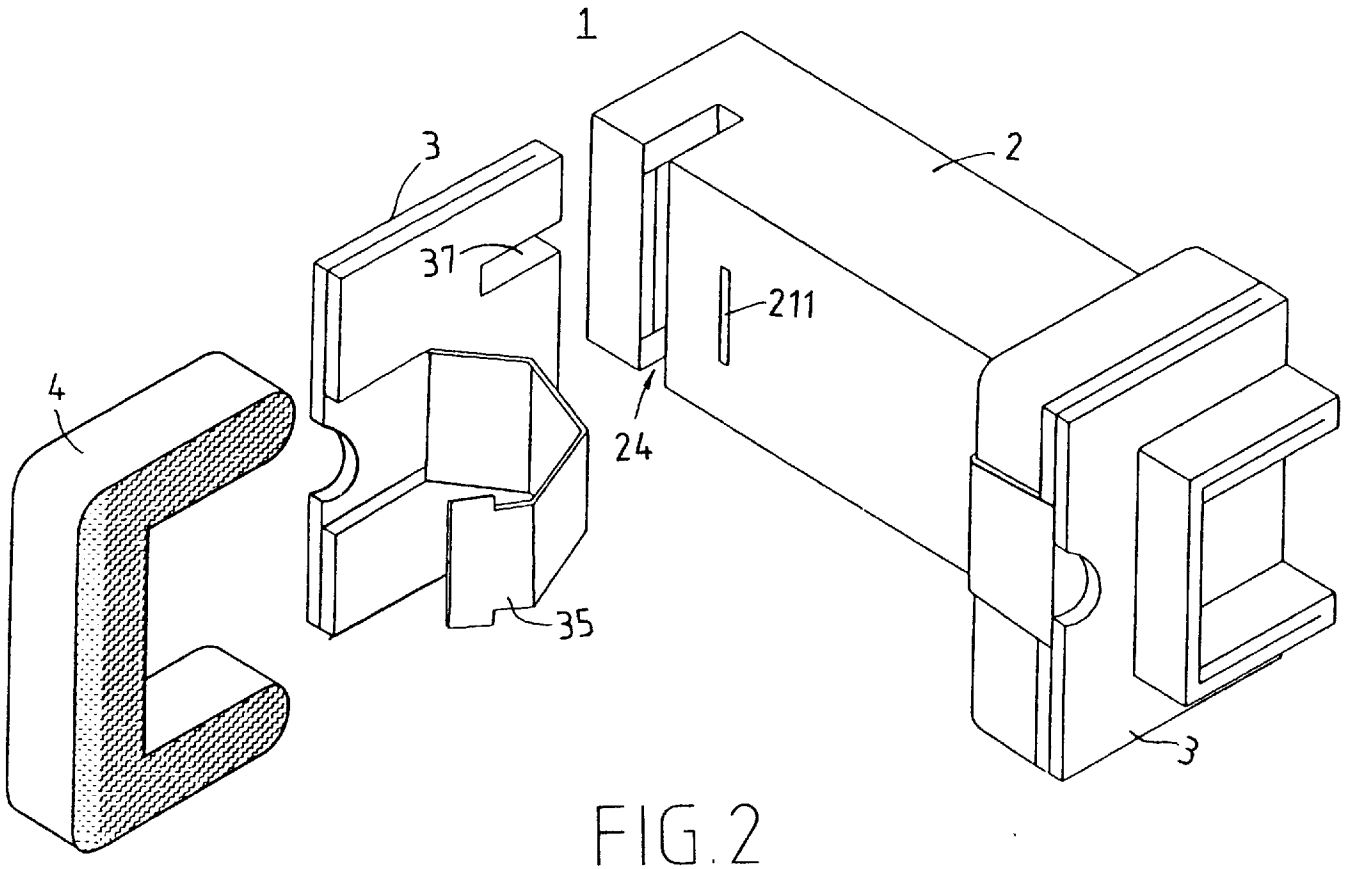
FIG. 2 is an exploded perspective view of the buffeting pad shown in FIG. 1, showing particularly three constituent parts of the buffering pad.

Referring further to FIG. 2, each buffering unit 1 is composed of three separate parts: a main member 2 having two first insetting slots 24 formed thereon, two lateral supporting members 3 each having two second insetting slots 37 formed thereon, and a protection member 4. The lateral supporting member 3 is integrally formed with a buckling piece 35 and is joined to the main member 2 by insetting the two second insetting slots 37 in the lateral supporting member 3 into the first insetting slots 24 in the main member 2. The protection member 4 is formed by multiple layers of cardboard and cut into substantially a U-shaped block. The protection member 4 is attached and fastened to the main member 2 by the bucking piece 35 of the supporting member 3.

Figure 3:
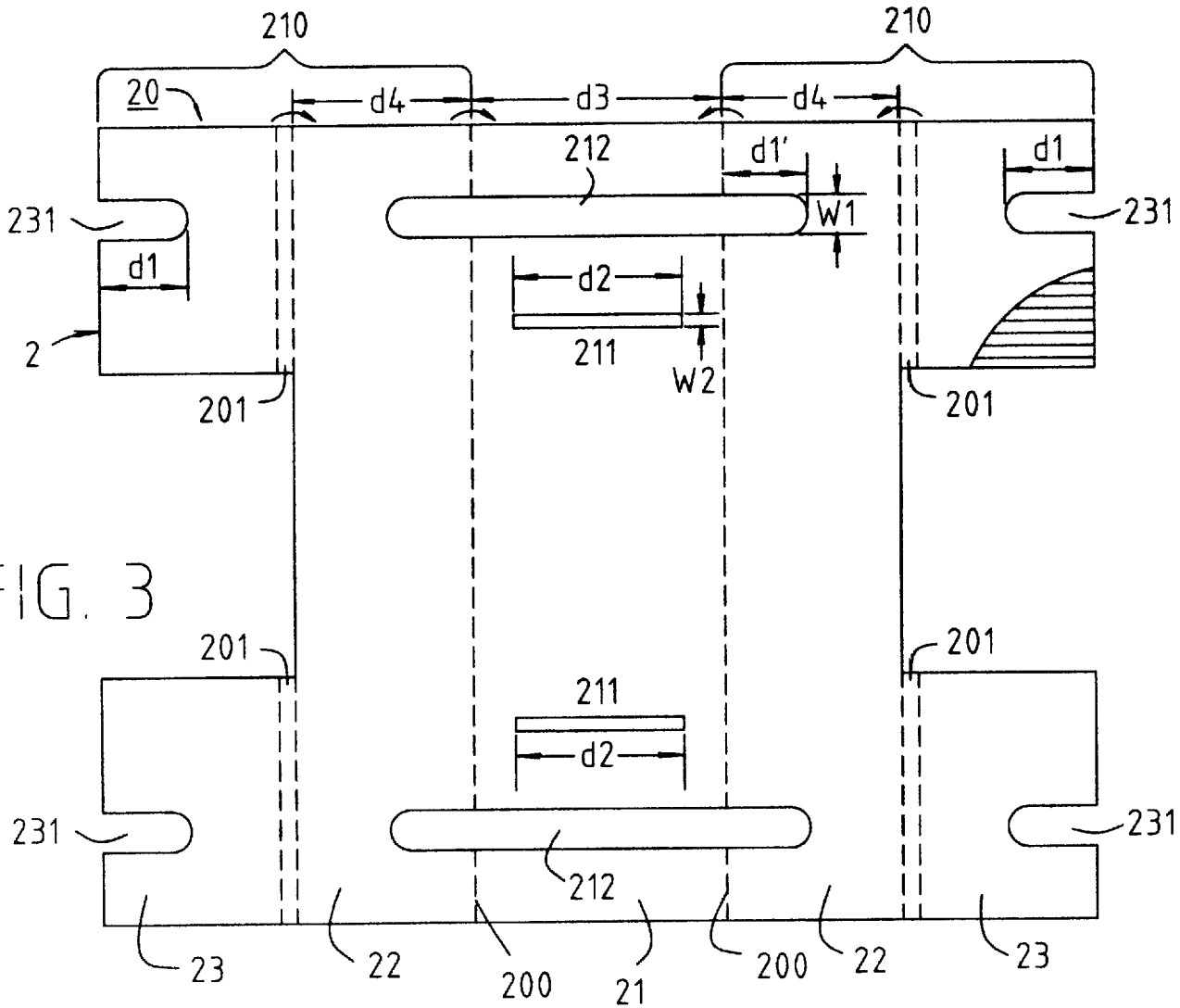
FIG. 3 is a plan view of the paper cut design of a main member of the buffering pad shown in FIG. 1.
Figure 4:
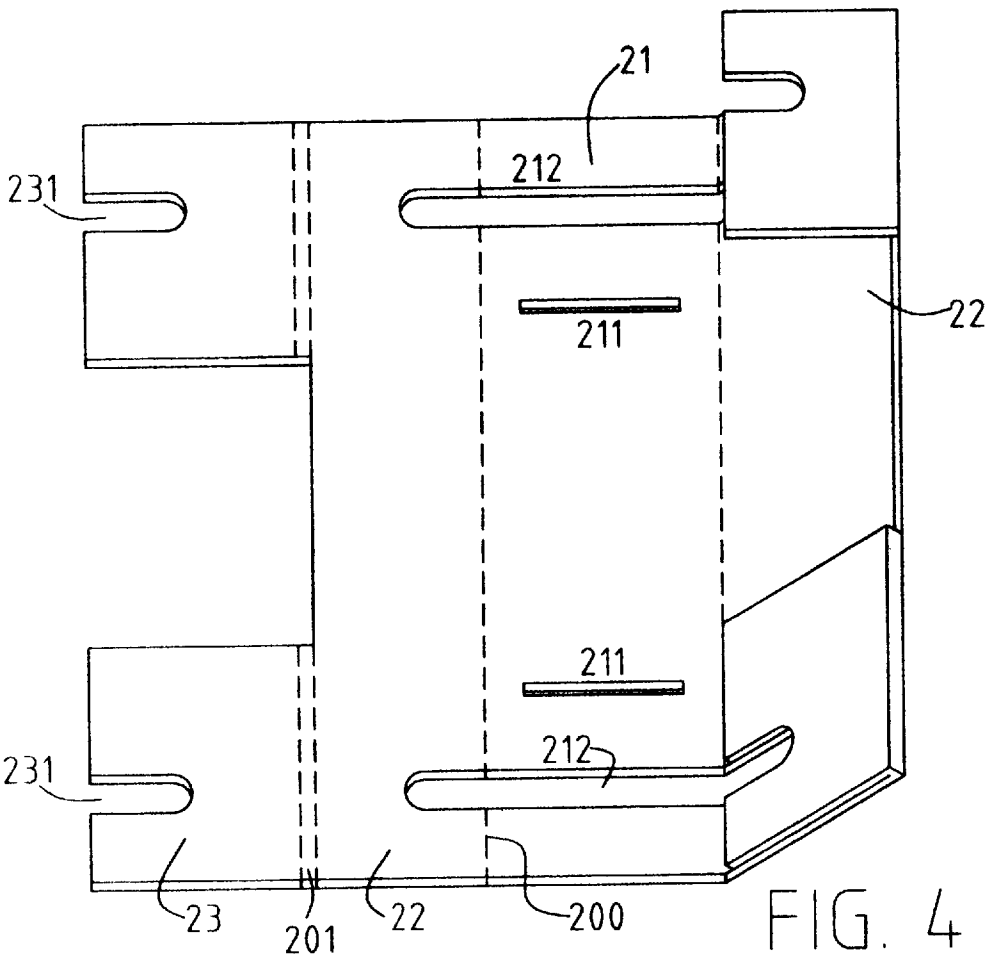
FIG. 4 shows how the main member shown in FIG. 3 is to be folded into form.

The main member 2 is formed by folding an integral piece of cardboard 20 which is designed and cut as shown in FIG. 3. FIG. 4 shows how the design of cardboard of FIG. 3 is to be folded into form. The cardboard 20 has two parallel folding lines 200 (illustrated by dashed lines) in the middle, which divide the cardboard 20 into three sections: a base section 21 having a length of $d_3$, and two side sections 210. Each of the two side sections 210 has a pair of parallel folding lines 201 (illustrated by dashed lines), which divide each side section 210 into a sidewall piece 22 having a length of $d_4$ and two enforcement pieces 23. Each enforcement pieces 23 is formed with a cutaway portion 231 having a length of $d_1$. A pair of large elongated slots 212 having a length of $d_3+2\cdot d_1'$ and a height of $w_1$ are formed in the middle of the cardboard 20, and a pair of small elongated slots 211 having a length of $d_2$ and a height of $w_2$ are formed beside the large elongated slots 212.

When folding the cardboard 20 into form, the enforcement pieces 23 are folded up about the folding lines 201 such that the enforcement pieces 23 are stacked over the sidewall piece 22, as illustrated in FIG. 4. Also, the cutaway portions 231 in the enforcement pieces 23 are mated to the $d_1'$ portions of the large elongated slots 212 in the sidewall piece 22. Onwards, the sidewall pieces 22 are folded up about the folding lines 200. This forms the main member 2 which is substantially U-shaped in cross section. The large elongated slots 212 and the mated cutaway portion 231 in combination form a first insetting slot 24 (shown in FIG. 2), which is used to combine the main member 2 with the lateral supporting member 3. The small elongated slots 211 allow the buckling piece 35 on the lateral supporting member 3 to buckle therethrough so as to fasten the lateral supporting member 3 to the main member 2.

The cutaway portions 231 have a length of $d_1$ and the large elongated slots 212 have a length of $d_3+2\cdot d_1'$, where $d_1'$ is the length of the side portion of the large elongated slots 212 in the sidewall piece 22 and $d_3$ is the length of the middle portion of the large elongated slots 212 in the base section 21. The cutaway portions 231 and the large elongated slots 212 all have the same height of $w_1$. The small elongated slots 211 has a height of $w_2$ and a length of $d_2$, where $d_2<d_3$. The sidewall pieces 22 have a length of $d_4$. These dimensions are determined in such a manner as to allow convenient folding of the cardboard 20 into form. Therefore, $d_1'$ is lightly greater than $d_1$; $d_2$ and $w_2$ allow the buckling piece 35 on the lateral supporting member 3 to pass therethrough; $d_3$ is dependent on the size of the device P being packed; and $d_4$ is the length that provides optimal cushion effect for the device P being packed.

Figure 5:
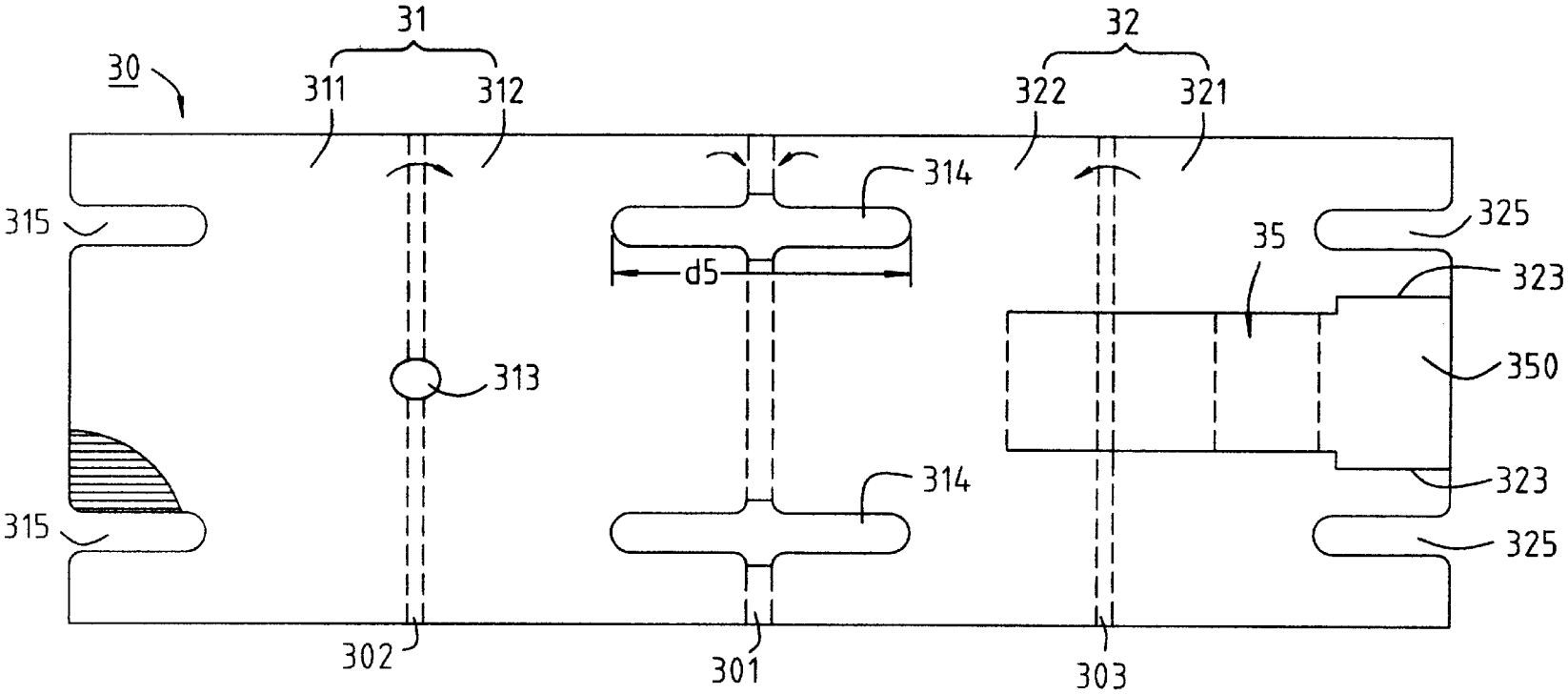
FIG. 5 is a plan view of the paper cut design of a lateral supporting member of the buffering pad of FIG. 1.
Figure 6A:
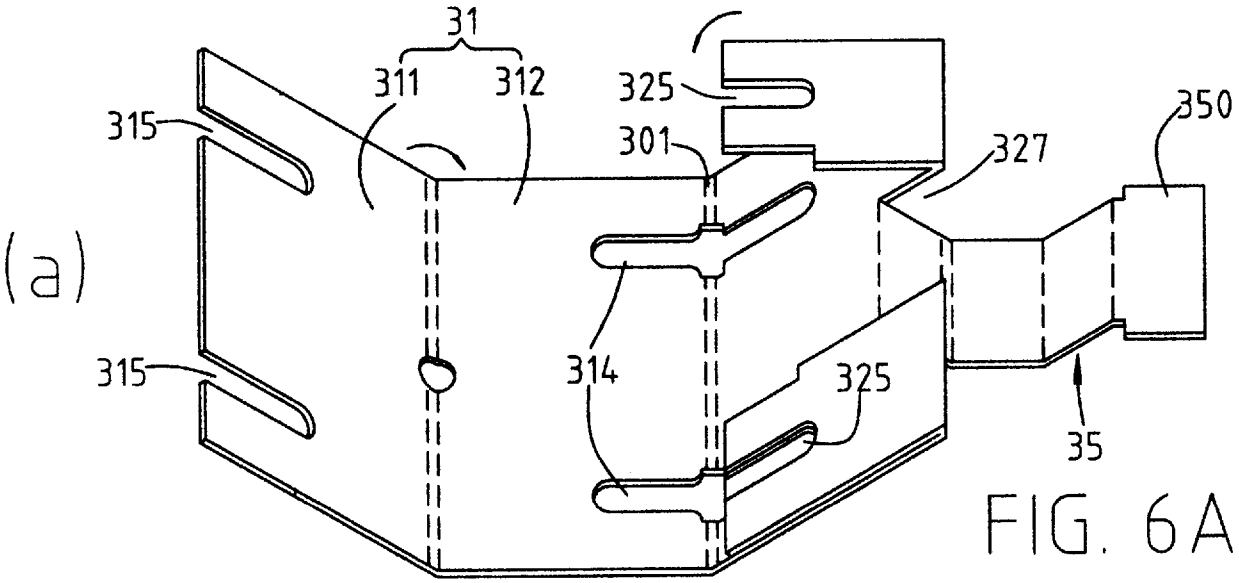
FIGS. 6A and 6B show how the lateral supporting member shown in FIG. 5 is to be folded into form.
Figure 6B:
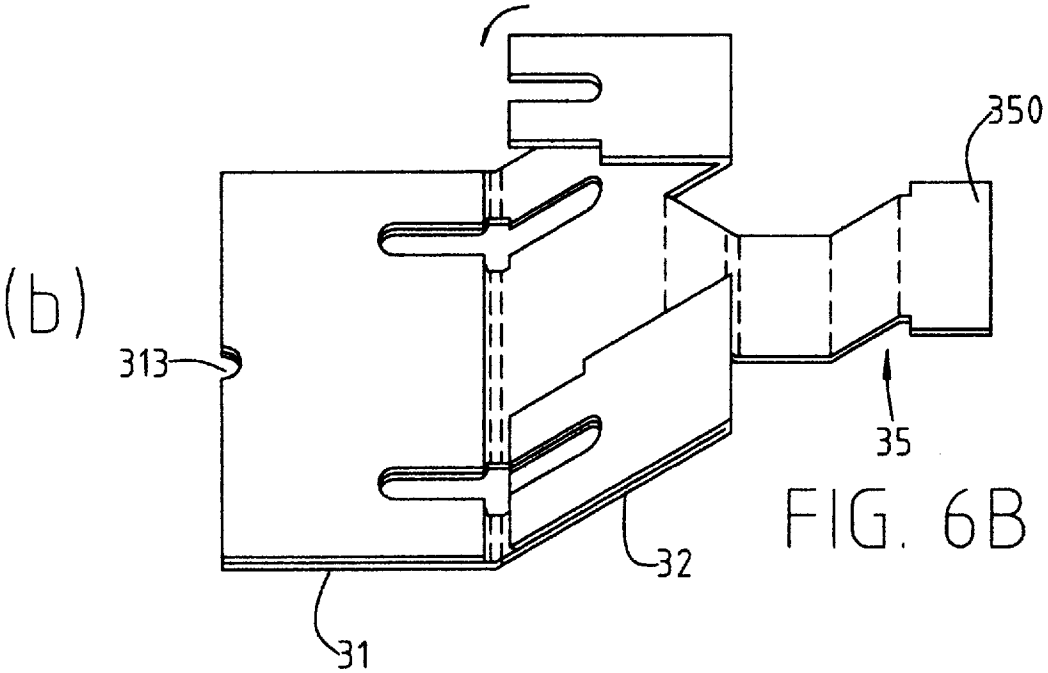

The structure of the lateral supporting member 3 is shown in FIG. 5 and FIGS. 6A and 6B. The lateral supporting member 3 is formed by folding an integral piece of cardboard 30 which is designed and cut as shown in FIG. 5. FIGS. 6A and 6B show how the design of cardboard of FIG. 5 is to be folded into form. The cardboard 30 has a pair of parallel folding lines 301 (illustrated by dashed lines) in the middle, which divide the cardboard 30 into an outer wall piece 31 and an inner wall piece 32. A pair of elongated slots 314 are formed in symmetry about the folding lines 301, each having a length of $d_5$. The separating distance between these two elongated slots 314 are designed equal to the separating distance between the two large elongated slots 212 in the main member 2. The length $d_5$ of the elongated slots 314 is about equal to the distance from the end of the first insetting slot 24 to the edge of the sidewall pieces 22. The outer wall piece 31 has a pair of folding lines 302 (illustrated by dashed lines) in the middle, which divide the outer wall piece 31 into an auxiliary piece 311 and a wall piece 312. A circular hole 313 is formed on the folding lines 302, which is used to assist the buckling piece 35 to be inserted into between the outer wall piece 31 and the inner wall piece 32. A pair of cutaway portions 315 are formed on one side of the auxiliary piece 311, which are respectively aligned with the elongated slots 314. Similarly, the inner wall piece 32 has a pair of folding lines 303 (illustrated by dashed lines) in the middle, which divide the inner wall piece 32 into an auxiliary piece 321 and a wall piece 322. A pair of cutaway portions 325 are formed on one side of the auxiliary piece 321, which are respectively aligned with the elongated slots 314. On the inner wall piece 32, a buckling piece 35 is formed by cutting along the solid lines 323. Three folding lines illustrated by dashed lines are formed on the buckling piece 35. The serves as a buckling head 350 which is to be engaged with the protection member 4. As shown in FIG. 6A, the cardboard 30 is folded on the folding lines 302 and folding lines 303, allowing the cutaway portions 315 to be mated to the left portions of the elongated slots 314, and the cutaway portions 325 mated to the right portions of the same. Further, as shown in FIG. 6B, the cardboard 30 is onwards folded on the folding lines 301, allowing the cutaway portions 315, the cutaway portions 325, and the elongated slots 314 to be combined into second insetting slots 37 (FIG. 2).

Figure 7:
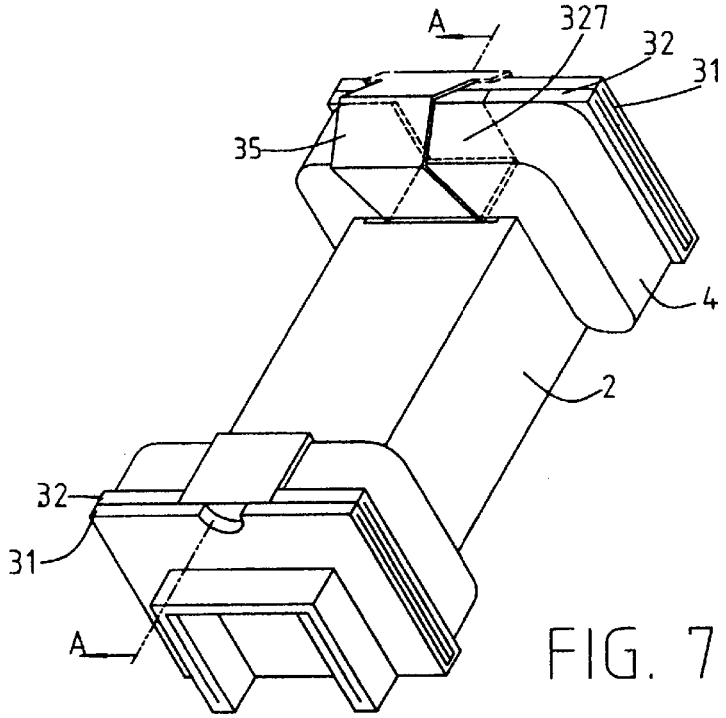
FIG. 7 is a perspective view, showing the assembly of the constituent parts of the buffering pad.
Figure 8:
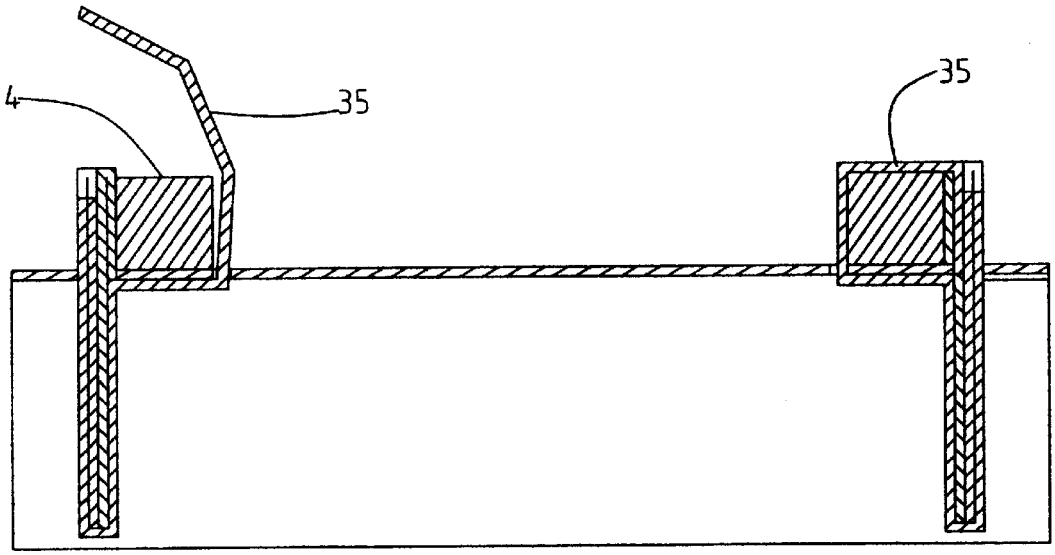
FIG. 8 is a sectional view of the assembly of FIG. 7 cutting through the line A—A.

Referring to FIGS. 7 and 8, a pair of the lateral supporting members 3 are combined with the main member 2 by insetting the second insetting slots 37 on the lateral supporting members 3 into the first insetting slots 24 on the main member 2, and also by buckling the buckling piece 35 in the main member 2 through the small elongated slots 211. After the lateral supporting members 3 are mounted in position in the main member 2, the protection members 4 are attached to the main member 2 at a position between the first insetting slot 24 and the small elongated slot 211. Then, the buckling piece 35 is folded up towards the protection member 4, and then the outermost part 350 of the buckling piece 35 is inserted into a slot 327 which is formed by cutting the inner wall piece 32 on the lateral supporting member 3 into form. This allows the protection member 4 to be fastened in position to the main member 2 and lateral supporting member 3 by the buckling piece 35. Alternatively, the fastening of the protection member 4 to the main member 2 can be made by first placing the buckling piece 35 on the protection member 4, and then inserting the buckling head 350 of the buckling piece 35 into the slot 327 in the lateral supporting member 3. So as to allow for easy insertion of the buckling head 350 of the buckling piece 35 into the slot 327, the buckling head 350 thereof can be formed with a smaller thickness by, for example, removing the inside layer of the cardboard.

Figure 9:
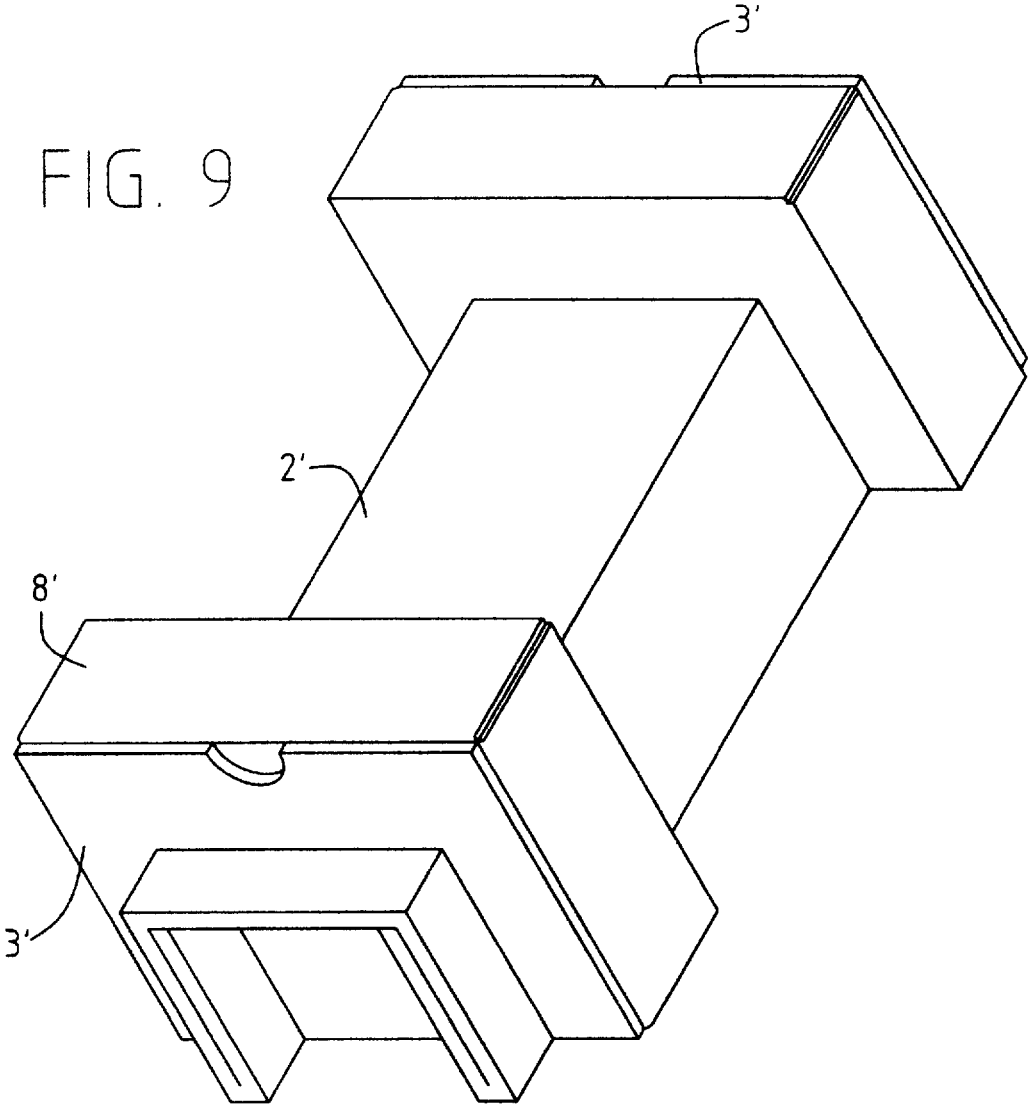
FIG. 9 is a perspective view of a second preferred embodiment of the buffering pad according to the present invention.
Figure 11:
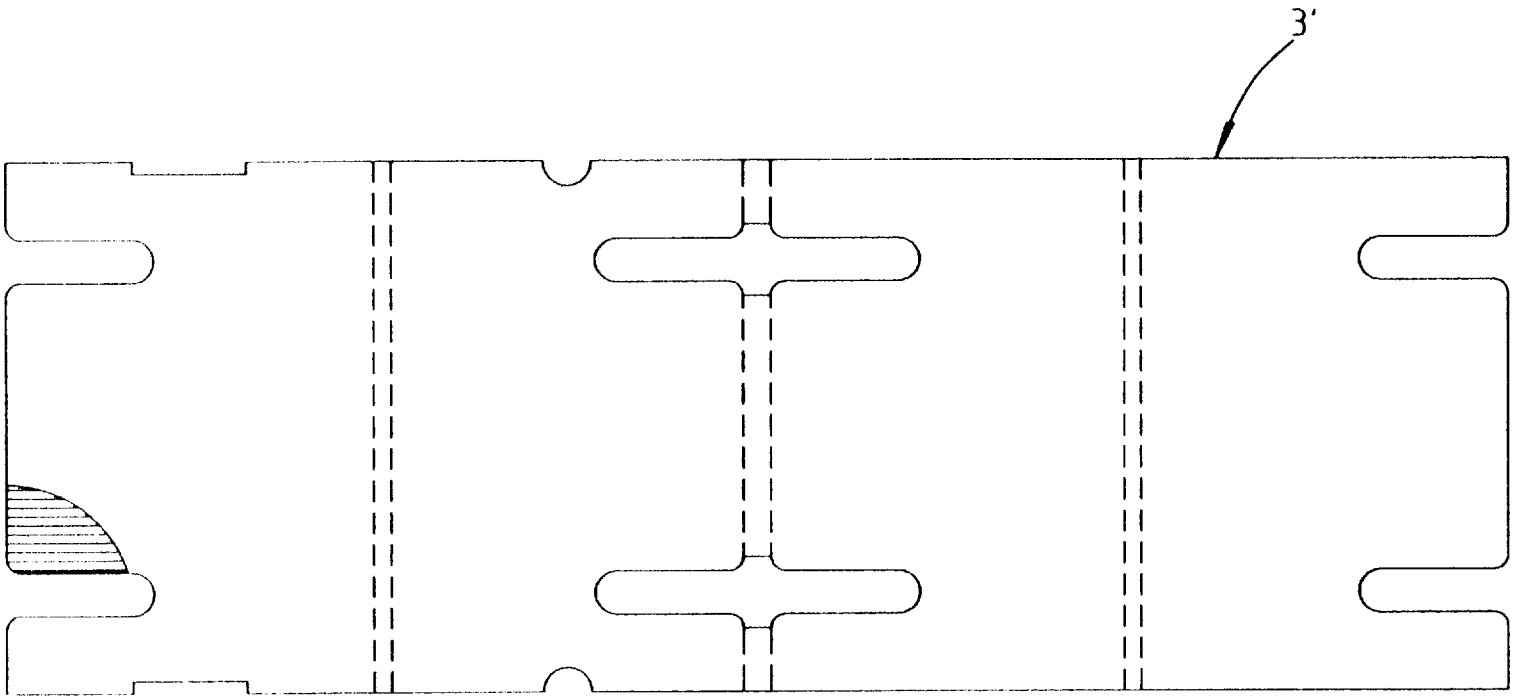
FIG. 11 is a plan view of the paper cut design of a lateral supporting member employed in the second embodiment of the buffering pad.

FIG. 9 is a perspective view of a second preferred embodiment of the buffering pad according to the present invention. This buffering pad is substantially identical in structure as the previous embodiment, except that here a supporting glove 8' (instead of the buckling piece 35 in the previous embodiment) is used to fasten the protection member 4' in position. As shown in FIG. 11, this lateral supporting member 3' here in this embodiment is not formed with a buckling piece. As shown in FIG. 10, the supporting glove 8' is formed by folding an integral piece of cardboard 80' which is designed and cut as shown in FIG. 10. The cardboard 80' is divided into a main piece 801' and a pair of wing pieces 802'. The main piece 801' is formed with a pair of slits 803' (illustrated by solid lines) on each end portion thereof which are joined to a pair of lengthwise folding lines 804' (illustrated by dashed lines). Further, a crosswise folding line 805' (illustrated by dashed line) is formed perpendicular to the slits 803' and folding lines 804' and which passes the joints of the slits 803' and folding lines 804'. This divides the cardboard 80' into a flap piece 806', a pair of lateral flap pieces 807', and a pair of engaging pieces 808'. Further, a head engaging piece 809' is formed on the top of the flap piece 806', and a pair of lateral engaging pieces 810' are formed on the lateral flap pieces 807'.

Figure 12:
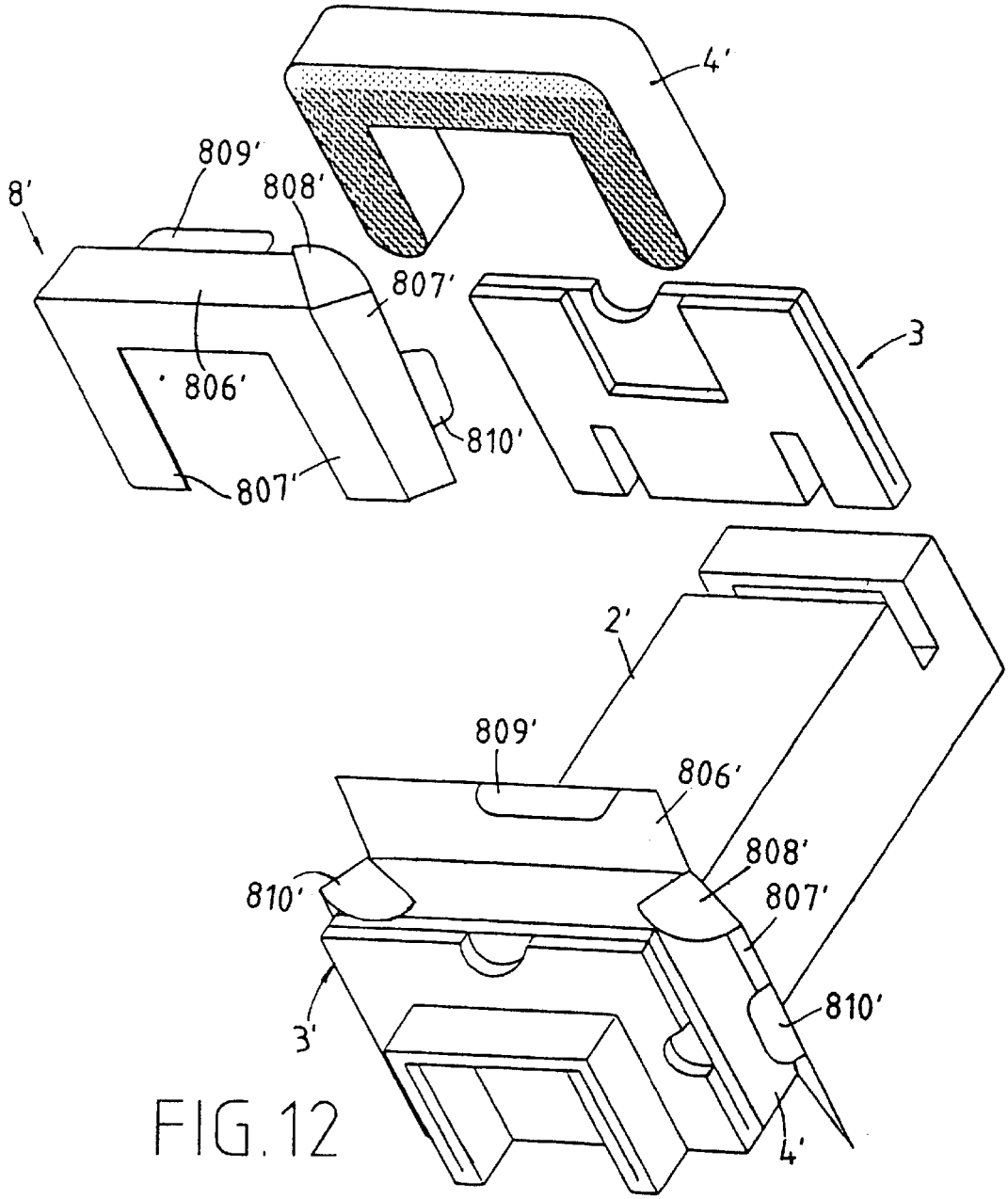
FIG. 12 is an exploded perspective view, showing the assembly of the constituent parts of the second embodiment of the buffering pad.

Referring to FIG. 12, to assemble the buffering pad of the second embodiment, the flap piece 806' and the two lateral flap pieces 807' on the supporting glove 8' are folded up in the same direction so as to let them be aligned vertically with respect to the main piece 801' and the wing pieces 802'. Thereafter, the supporting glove 8' is attached onto the protection member 4' on the main member 2'. Moreover, the head engaging piece 809' and lateral engaging pieces 810' of the supporting glove 8' are inserted into the gap between the outer wall piece 31 and the inner wall piece 32 on the lateral supporting member 3'; and the engaging pieces 808' are respectively inserted into the gaps between the flap piece 806' and the protection member 4'. This allows protection member 4' to be fastened to the main member 2' and lateral supporting member 3' by means of the supporting glove 8'. The assembly for the buffering pad is thus completed. By means of the main piece 801' and the wing pieces 802' of the supporting glove 8' supporting the main member 2', the buffering pad is enforced in strength to support and protect the device wrapped by the buffering pad.

Figure 13:
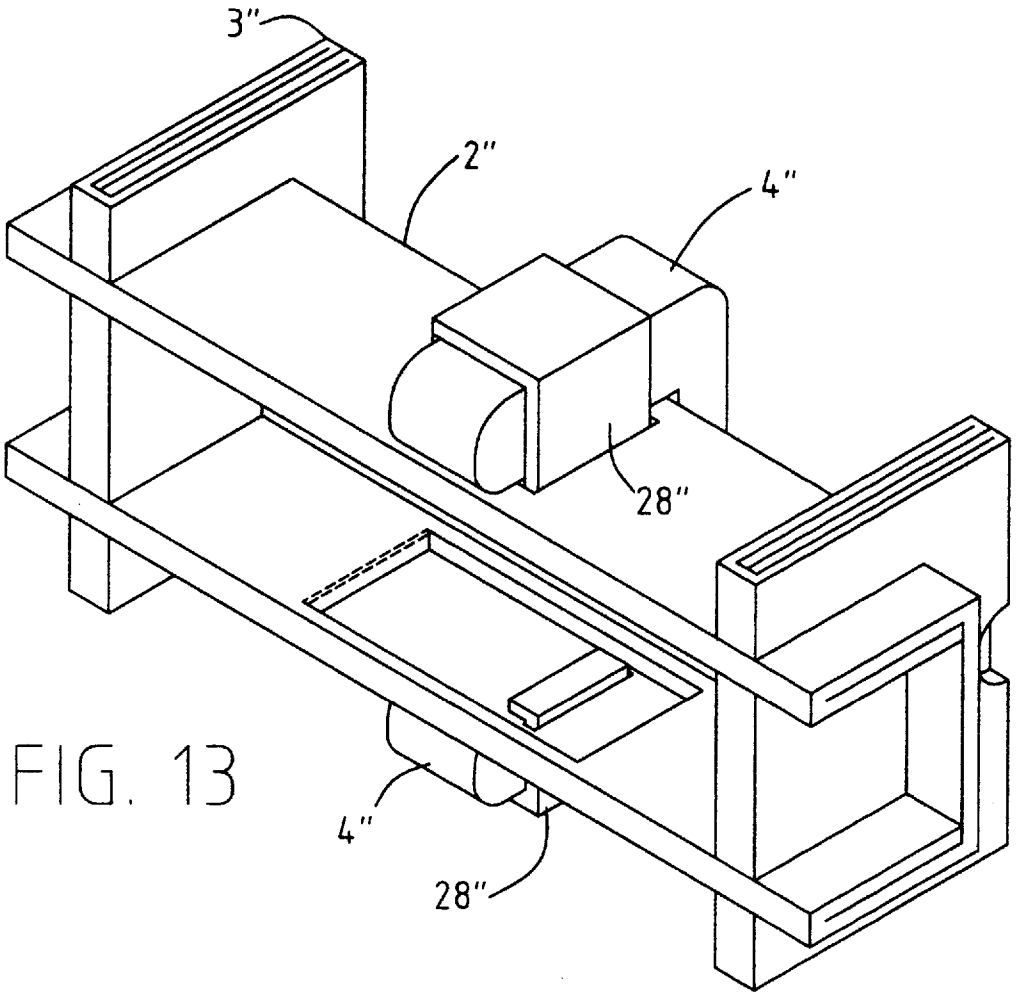
FIG. 13 is a perspective view of the third preferred embodiment of the buffering pad according to the present invention.

FIG. 13 is a perspective view of a third preferred embodiment of the buffering pad according to the present invention. This embodiment is substantially identical in structure as the previous embodiments except that here the protection member 4" is mounted on the middle of the main member 2". The lateral supporting member 3" is here identical in structure as that in the second embodiment (FIG. 11) which is not provided with a buckling piece. Further, the protection member 4" is fastened to the main member 2" by means of a pair of buckling pieces 28" formed on the main member 2".

Figure 14:
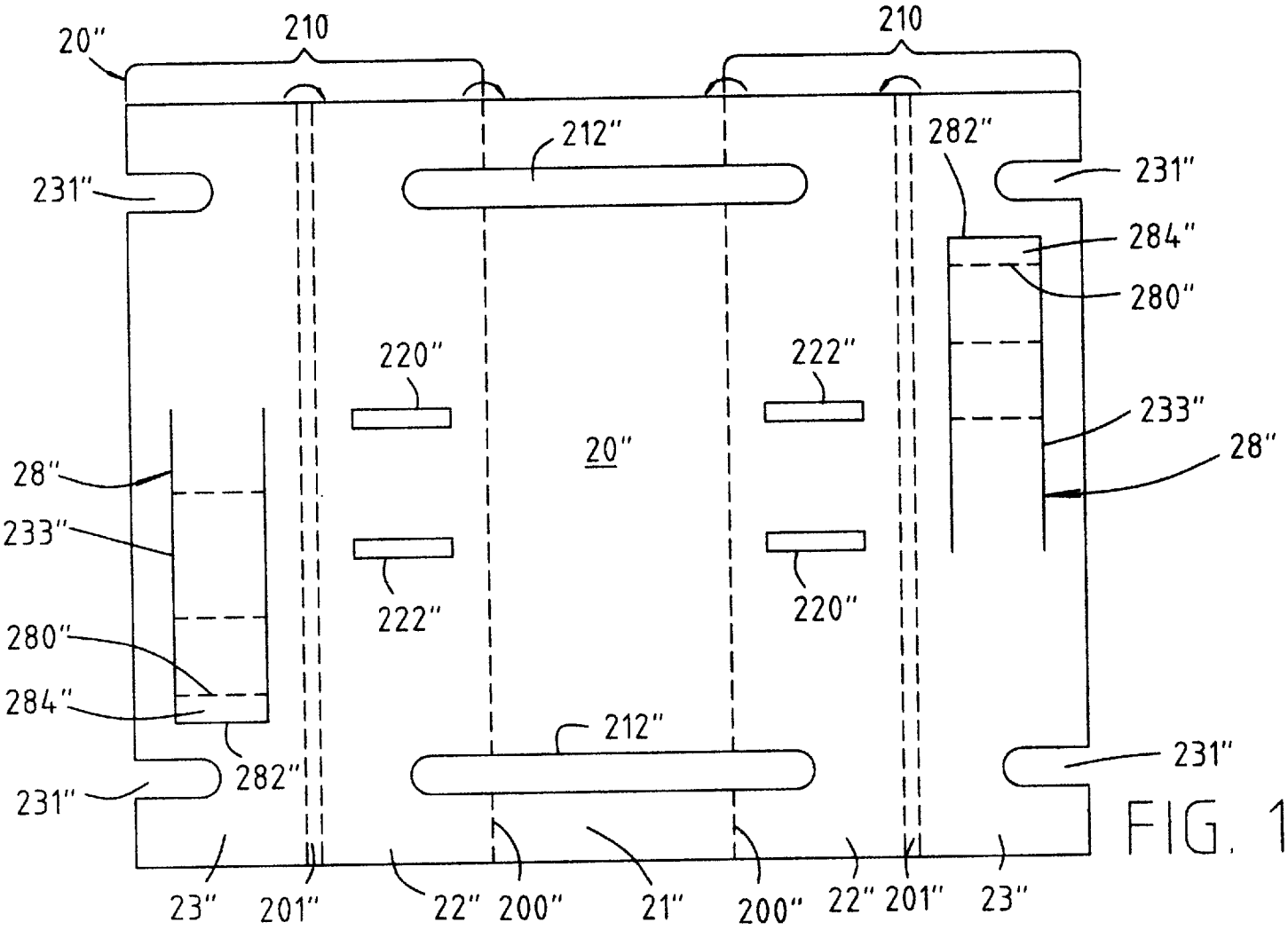
FIG. 14 is a plan view of the paper cut design of a main member used in the third embodiment of the buffering structure according to the present invention.

Referring to FIG. 14, the main member 2" is formed by folding an integral piece of cardboard 20" which is designed and cut as illustrated. The cardboard 20" has two folding lines 200" (illustrated by dashed lines) in the middle, which divide the cardboard 20" into a base section 21" and two side sections 210". A pair of folding lines 201" (illustrated by dashed lines) are formed in the middle of each of the side sections 210", which divide each of the side sections 210" into an outer wall piece 22" and an inner wall piece 23". A pair of large elongated slots 212" are formed in the middle of the cardboard 20", which cross the folding lines 200" to extend from the base section 21" to the two surrounding sidewall piece 22". Cutaway portions 231" are formed on one side of each of the inner wall pieces 23", which are aligned with the large elongated slots 212" in the middle. Further, a pair of small elongated slots 220", 222" are formed respectively on each of the sidewall piece 22". Further, a cutting line 233" (illustrated by solid line) is formed on each of the inner wall pieces 23", which is cut to form a buckling piece 28". The buckling piece 28" on the left inner wall piece 23" extends downwards while that on the right inner wall piece 23" extends upwards. Each of the buckling pieces 28" is further formed with three folding lines 280" (illustrated by dashed lines). The outermost part 284" of each of the buckling pieces 28" serves as a buckling head.

The assembly of the buffering pad is substantially the same as the first embodiment, except that, when folding the inner wall pieces 23" up toward the outer wall piece 22", the buckling pieces 28" should penetrate through the small elongated slots 220" and expose the buckling head thereof to the outside of the outer wall piece 22". Further, as shown in FIG. 13, the lateral supporting members 3" are joined to the main member 2", and the protection member 4" is attached to the main member 2". When mounted in position, the protection member 4" is located to the rear between the small elongated slots 220" and 222", allowing the buckling pieces 28" to strap around the protection member 4". Thereafter, the buckling heads 284" of the buckling pieces 28" are inserted into the small elongated slots 222", allowing the protection member 4" to be firmly fastened to the main member 2".

In conclusion, the buffering pad of the invention is completely made of cardboard. The constituent parts of the buffering pad, i.e., the main member, the lateral supporting member, and the protection member all are made from a single piece of cardboard designed in specific paper cut forms that allow the buffering pad to be manufactured easily. Moreover, these three parts can be easily combined with each other without the use of glues, staples, or any other fastening means. The buffering pad is recyclable and environment-friendly. Further, when not in use, the buffering pad can be unfolded into a plane sheet that allows easy storage, portability, and transportation. The cost can thus be lowered to the minimum.

Furthermore, the buffering pad can be varied in size, weight, or form with respect to the device to be packed therein. For instance, the protection member can be formed with a greater width to provide increased strength for protecting the device against strong shocks or impacts. The protection member can be varied in position for balancing the center of weight of the device being packed in the buffering pad.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A buffering pad for a device package, comprising:

a main member, which is folded into form from a first substrate and is formed with at least two first insetting slots and at least two second elongated slots;

at least two lateral supporting members, each being formed with a plurality of second insetting slots corresponding to said first insetting slot on said main member, said lateral supporting member being combined with said main member by insetting said second insetting slots on said lateral supporting member into said first insetting on said main member; said lateral supporting member being formed with a buckling piece; and a protection member, which is substantially a U-shaped block, fastened to said main member by strapping said buckling piece on said lateral supporting member around said main member.

2. The buffering pad of claim 1, wherein said first substrate includes a base section, a pair of sidewall pieces joining said base section, and a pair of enforcement pieces joining each of said sidewall pieces; said first substrate is formed with at least a pair of first elongated slots which extend over said base section and said sidewall pieces and said second elongated slots which extend over said base section; said first elongated slots are formed into first insetting slots of said main member.

3. The buffering pad of claim 1, wherein said lateral supporting members are each formed by folding a second substrate which is formed with a first pair of folding lines to divide said second substrate into an outer wall piece and an inner wall piece.

4. The buffering pad of claim 3, wherein said outer wall piece is formed with a second pair of folding lines to divide said outer wall piece into an auxiliary piece and a wall piece; and said inner wall piece is formed with a third pa of folding lines to divide said inner wall piece into an auxiliary piece and a wall piece.

5. The buffering pad of claim 1, wherein said member wall piece on said lateral so member is formed with a buckling piece having a length less than the circumferential length of said protection member and a width allowing said buckling piece to pass through said second elongated slots on said main member.

6. The buffering pad of claim 5, wherein said bucking piece is formed with three folding lines which are folded to allow said buckling piece to strap around said protection member, the free end of said buckling piece serving as a buckling head.

7. The buffering pad of claim 4, wherein said outer wall piece is formed with a circular hole on said second pair of folding lines, said circular hole being used to assist said buckling piece to be inserted into between said outer wall piece and said inner wall piece.

8. The buffering pad of claim 1, wherein said buckling piece on said lateral supporting member straps around said protection member by folding on the folding lines on said buckling piece, and said buckling head of said buckling piece is inserted into a gap between said outer wall piece and inner wall piece of said lateral supporting member, so as to fasten said protection member to said main member.

9. The buffering pad of claim 1, wherein said protection member is fastened to said main member by the following steps of:

folding said buck piece on the folding lines thereon;

wrapping said buckling piece around said protection member, and inserting said buckling head of said bucking piece into said second elongated slots on said main member.

* * * * *

UNITED STATES PATENT AND TRADEMARK OFFICE

CERTIFICATE OF CORRECTION

PATENT NO. : 5,772,025

DATED : June 30, 1998

INVENTOR(S) : Tony CHEN and Alex WANG

It is certified that error appears in the above-indentified patent and that said Letters Patent is hereby corrected as shown below:

ON THE TITLE PAGE:

[73] Assignee: UMAX DATA SYSTEMS INC., Hsinchu, Taiwan, R.O.C.

Column 2, line 45, change "bucking" to -- buckling --;

Column 3, line 43, change "buffeting" to -- buffering --;

Column 4, line14, change "deuce" to -- device --;

Column 8, line 33, after "insetting" insert - - slot --;

Column 8, line 58, change "pa" to -- pair --;

Column 8, line 62, after "said" (first occurrence), delete "member" and insert -- inner -- therefore;

Column 8, line 62, after "lateral", delete "so" and insert -- supporting -- therefore;

Column 9, line 1, change "bucking" to -- buckling --;

Column 10, line 8, change "buck" to - - buckling - -;

UNITED STATES PATENT AND TRADEMARK OFFICE

CERTIFICATE OF CORRECTION

PATENT NO. : 5,772,025

DATED : June 30, 1998

INVENTOR(S) : Tony CHEN and Alex WANG

It is certified that error appears in the above-indentified patent and that said Letters Patent is hereby corrected as shown below:

Column 10, line 12, after said (second occurrence) change "bucking" to -- buckling --.

Signed and Sealed this

Sixth Day of March, 2001

Nicholas P. Godici

*Attest:*

NICHOLAS P. GODICI

*Attesting Officer*

*Acting Director of the United States Patent and Trademark Office*